United States Patent [19]

Jarvis, Sr.

[11] Patent Number: 4,774,859

[45] Date of Patent: Oct. 4, 1988

[54] OPENER FOR TAB-TOP CONTAINER

[76] Inventor: Darcey L. Jarvis, Sr., 7235 Schaefer Rd., Dearborn, Mich. 48126

[21] Appl. No.: 131,155

[22] Filed: Dec. 10, 1987

[51] Int. Cl.[4] ..... B67B 7/40

[52] U.S. Cl. ..... 81/3.27; 81/3.55

[58] Field of Search ..... 81/3.25, 3.27, 3.07, 81/3.36, 3.55

[56] References Cited

U.S. PATENT DOCUMENTS

| | | | |
|---|---|---|---|
| 3,572,186 | 3/1971 | Dillard | 81/3.27 |
| 4,663,994 | 5/1987 | Hull | 81/3.27 |
| 4,712,454 | 12/1987 | Hull et al. | 81/3.27 |

*Primary Examiner*—Roscoe V. Parker

*Attorney, Agent, or Firm*—Cullen, Sloman, Cantor, Grauer, Scott & Rutherford

[57] ABSTRACT

An opener for a tab-top container has a base adapted to be mounted to a supporting surface. Opposing camming surfaces convergently extend from the base to a juncture. An initiating edge formed at the juncture is used to be positioned under the edge of a tab so that when the container is pushed generally toward the base, the tab is cammed away from the end wall causing the closure to responsively open. A method suggested by use of the tab opener is disclosed.

10 Claims, 1 Drawing Sheet

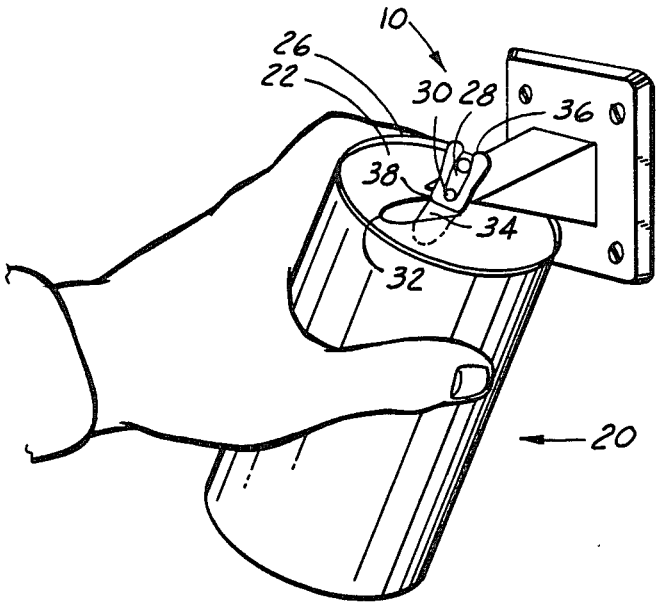
FIG. 1
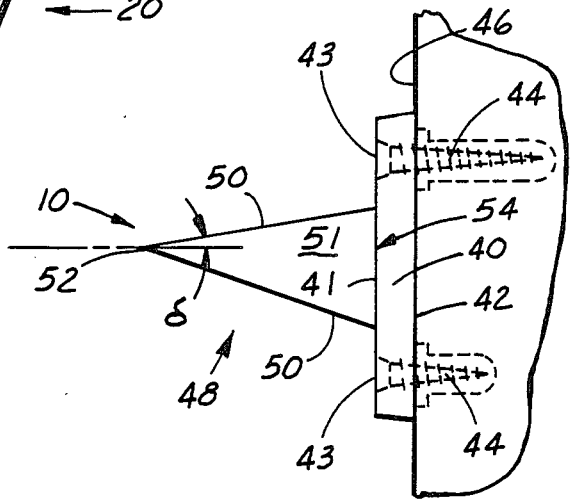
FIG. 2
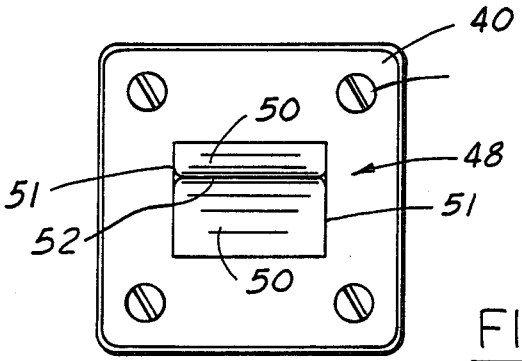
FIG. 3
FIG. 4
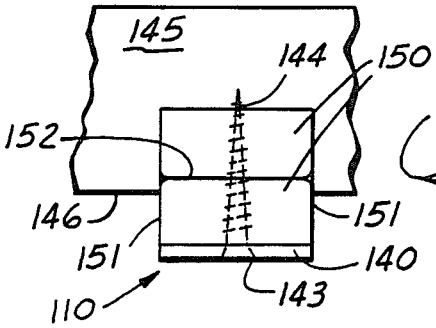
FIG. 5
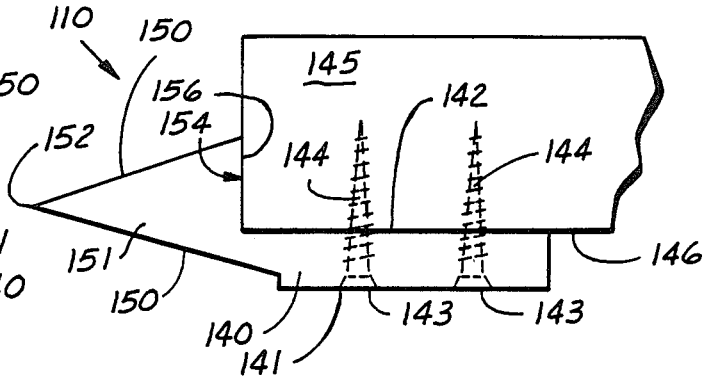

OPENER FOR TAB-TOP CONTAINER

FIELD OF THE INVENTION

The present invention relates generally to openers for beverage containers, usually referred to as "can openers." More particularly, the invention relates to beverage can openers that are mounted on support surfaces so that a container may be opened with little difficulty while being supported and controlled by one hand. Still more particularly, the invention relates to a mounted opener for a tab-top container that has an end wall with a tab and an end wall closure that is openable responsively to the tab being pivoted when the can and the opener are manipulated with respect to the opener.

BACKGROUND OF THE INVENTION

Most present-day containers that are not bottles, but which contain beverages such as soft drinks and beer, have end walls with closures that are openable by manipulation of a pivotable tab attached to the container end wall or the closure or both. Such containers or "cans," as they often are called, are usually manufactured to be opened by a consumer using the natural wedge of his or her finger. Initially, the consumer's fingernail is to be inserted between the tab and the end wall of the can; then the fleshy tip of the finger is to follow; finally, when the tab has pivoted enough to accommodate the end of the finger to the distal joint, the finger is to exert sufficient leverage to lift the tab to the disposition in which the end closure is opened.

What manufacturers of tab-top containers had contemplated as a relatively simple and routine task has commonly been problematic. Broken fingernails have resulted from the step of inserting fingernails; cut flesh has often resulted from the step of pressing against the tab with the fleshy part of the finger; and the step of lifting a tab with the end of the finger has often proven virtually impossible for consumers of less than average dexterity, including children, the aged, and the arthritic.

PRIOR ART

The difficulties associated with opening tab-top containers have spurred the development of several inventions which, despite their advantages over methods of opening tab-top cans without using tools, suffer disadvantages when compared with the present invention.

As a first example, U.S. Pat. No. 4,617,842 issued to Yang discloses a combination cap and can opener that has a single working end suitable both for opening a capped bottle and for opening a tab-type can. The opening having been made for portability depends on leverage attainable by the consumer holding the container with one hand while manipulating the opener with the other. This is a disadvantage under circumstances when the consumer has only one conveniently free hand to open a tab-top container, as when in the interest of efficiency a fountain clerk opens a bottle while reaching for a straw. Also, the portable opener of Yang requires stabilizing the opener on the can while pushing it or prying with it, involving relatively complex manipulation when compared to the invention that is the subject matter of the present disclosure.

U.S. Pat. No. 4,563,919 issued to Sellars discloses a tool for opening beverage cans having a tab or "flip-top" structure. The structure of the tool, which calls for two downwardly-projecting rails that cooperate to form a channel to guide a blade to its ultimate position in the process of opening a can, involves the same complexities of the Yang device. Also of interest, regarding the Sellars reference, is its discussion of other prior art, including openers disclosed in U.S. Pat. No. 4,474,087 issued to Widman and U.S. Pat. No. 4,416,171 issued to Chmela et al., both of which suffer the same disadvantages as Yang and Sellars when compared to the present invention.

U.S. Pat. No. 4,530,260 issued to Holka and U.S. Pat. No. 4,466,313 issued to Gardner disclose portable opener tools which call for the prying action required of the tools already discussed. Additionally, these tools call for an exact "aiming" to position the tool for its preferred operation. Such "aiming" is a disadvantage where a quick operation is required or the dexterity of the consumer is questionable.

U.S. Pat. No. 4,373,246 issued to VanHoutte et al. and U.S. Pat. No. 3,460,411 issued to Dyer disclose fulcrum-type tab openers requiring somewhat exact aiming, as well as two-handed operations involving lifting up on the instrument while firmly holding the can for leverage, this latter disadvantage being characteristic of the other discussed tab-top container openers. U.S. Pat. No. 4,241,626 issued to Hall discloses another fulcrum-type opener device consisting of a rod-like tool that has a handle on one end and a series of notches on the opposite end. The notches function to seat the tool on the rim of the can to be opened and, concurrently, as a fulcrum point. Again, this is a device calling for such exacting manipulation as to forsake efficiency in its use, especially where there is a need to open a significant number of cans in a short time, as would be a need in a bar or restaurant.

U.S. Pat. No. 3,459,075 issued to Henderson discloses an opening device that would appear to be easier to use than the aforementioned instruments. Still, more aiming is required than with the invention to be disclosed herein, and both hands need to be used for leverage as is not required in using the present invention.

U.S. Pat. No. 3,132,421 issued to Huck, Jr., U.S. Pat. No. 2,576,800 issued to Menderman, and U.S. Pat. No. 943,759 issued to Vaughan disclose surfacemounted openers that do not require a two-handed operation for leverage, although Huck, Jr. requires a second hand to ready the tool for operation. These inventions, however, are not adapted for use with tab-top containers.

OBJECTS OF THE INVENTION

Because of the difficulties associated with opening tab-top containers even with the several prior art inventions discussed, it is the object of the present invention to provide an opener for a tab-top container that provides sufficient leverage attainable by the consumer holding the container with one hand and, with the same hand, using minimal manipulative effort to open the tab-top.

Another object of the invention is to provide a tool requiring little "aiming" to position it for opening a tab-top beverage can.

Yet another object of the invention is to provide a device for opening a tab-top container without such exacting manipulation as to forsake efficiency in its use, especially where there is a need to open a significant number of containers in a short time.

Still yet another object of the present invention is to provide a support surface-mounted opener adapted to use with a tab-top container so as to provide an advantage of not requiring a two-handed operation for sufficient leverage to open the tab-top.

SUMMARY OF THE INVENTION

These and other objects are accomplished in the present invention by an opener for a tab-type container or "can," especially a container or can from which beverages are dispensed from an opening in the end wall of the container.

The particular type of container or can for which the present invention is adapted is characterized by closure in the end wall that closes off the opening until the closure is opened to dispense the beverage and which has a tab attached to the end wall, the tab being manipulatable in such a way as to open the closure. Usually the tab has a beveled edge disposed at one end of its two ends, while the other end lies proximate the closure or integral therewith. The tab is pivotable to bring the beveled edge, which initially lies substantially close to the end wall of the can, away from the end wall. The closure opens responsively to the tab being pivoted.

In particular, the present invention is a tab-top container opener which has a base adapted to be mounted to a supporting surface. Opposing camming surfaces converge from a divergent end of the opener, where means join the camming surfaces to the base, to a juncture forming an initiating edge. When the can is positioned so that the beveled edge of the tab overlies the initiating edge, the can may be pushed generally toward the divergent end of the opener to cam away the beveled edge of the tab from the end surface so as to cause the closure to responsively open.

BRIEF DESCRIPTION OF THE DRAWINGS

FIG. 1 is a view in perspective of the opener for a tab-top container, showing a hand-supported tab-top container being opened by a surface-mounted first embodiment of the invention and also showing, partly in phantom, an end wall closure for the container.

FIG. 2 is a side view of the first embodiment of the opener.

FIG. 3 is a front view of the first embodiment of the opener.

FIG. 4 is a front view of a second embodiment of the opener.

FIG. 5 is a side view of the second embodiment of the opener.

DETAILED DESCRIPTION OF THE PREFERRED EMBODIMENTS

Referring first to FIG. 1, a first embodiment of the opener 10 for a tab-top container, which is the subject matter of the present invention, is shown in use. The elements of the opener 10 and how the opener is mounted, to a wall for example, will be explained later in this specification. A tab-top container 20, typically containing a beverage such as beer or a soft drink, is thrust by the hand of a consumer toward the opener 10 to open the container 20 in a manner also to be explained later.

The container 20 is of a type that is on sale on the market; it is generally made of aluminum or an alloy having like properties. Such a container is well known to those of ordinary skill in the tab-top container art, as well as to the average consumer, as it is described in a clear, concise, and exact description in U.S. Pat. No. 4,617,184, which is incorporated herein for its description of a tab-top container.

The container 20 generally has an end wall 22. The end wall is typically convex outwardly from the container, and, where the end wall joins the usually cylindrical side wall 24, a parapeted-like rim 26 projects from the container.

A tab 28 is shown attached to the end wall 22 at a riveting point 30 adjacent an opening 32. A closure 34 is pivotable into the opening 32 to expose the opening 32, in contrast to the opening 32 being sealed by the closure 34 before the container 20 is opened to dispense the beverage inside. Both the opening 32 and the closure 34 are usually tongue-shaped.

The tab 28 has a leading, beveled edge 36 disposed at one of its two ends. As the container 20 is on sale in the market and stored until use, the beveled edge 36 lies substantially close to the end wall 22 of the container 20. The tab 28 is pivotable about the riveting point 30 when the tab 28 is pried upwardly away from the end wall 22 of the container 20 by leverage gained when a fingernail or a tool is inserted between the beveled edge 36 and the end wall 22.

Of the many variations of the tabs that are found on the end walls 22 of tab-top containers 20, some have a beveled edge around the periphery of each tab. Hence, the designation of the beveled edge 36 is meant only to specify that at least the edge under which the fingernail or tool is inserted is beveled to the extent that it might accommodate the fingernail or tool.

The opposite, other end 38 of the tab 28 overlies the closure 34. When the tab 28 is pivoted to bring the beveled edge 36 away from the end wall 22, the other end 38 of the tab 20 concomitantly pivots to press against the closure 34. Responsively, the closure 34 pivots inwardly into the opening 32. In short, the closure 34 opens responsively to the tab 28 being pivoted.

The first embodiment of the present invention, which is shown generally at 10 in FIGS. 1, 2 and 3, is shown with particularity in FIGS. 2 and 3.

With particular reference to FIG. 3, a rectangular-shaped mounting base 40 has a front face 41 and a back face 42. Spaced holes 43, each disposed in a corner of the rectangular base 40, are for receiving four screws, as 44, by means of which the opener 10 may be mounted to a supporting surface, as 46, with the back face 42 flush against the supporting surface 46 and the front face 41 facing outwardly away therefrom.

A wedge-shaped tool or wedge, designated generally at 48, is cantilevered from the mounting base 40. The wedge 48 is formed by oppositely diverging camming surfaces 50 and triangular sides 51. At least one of the camming surfaces 50 angles acutely upwardly from an initiating edge 52 at a free end. As shown in FIG. 2, a preferred angle $\delta$, one that has been demonstrated as efficient in a method to be explained later as usable with this embodiment of the opener 10, would be between 5 degrees and 10 degrees, so that the apex of one of the equilateral triangular sides 51 wold be between 10 degrees and 20 degrees. In particular, the angle of 8 degrees has worked well as $\delta$, so that the apex of a triangular side 51 is about 16 degrees.

The opposing camming surfaces 50 convergently extend from a divergent end 54 to a juncture that forms the intiating edge 52 at the free end. In this first embodiment, an integral junction of each of the camming surfaces 50 with the front face 41 of the base 40 provides means joining the divergent end 54 to the base 40. As can be seen with particularity in FIG. 2, the opposing camming surfaces 50 extend generally perpendicularly away from the base, respecting their convergence toward the initiating edge.

A second embodiment of the present invention is shown generally at 110 in FIGS. 4 and 5. As disclosed by the combination of figures, a mounting base 140 has a front face 141 and a back face 142. A pair of longitudinally spaced holes 143 are disposed therein for receiving two screws, as 144, by means of which the opener 110 may be mounted with the back face 142 flush against a supporting surface, as 146, here as shown beneath a counter 145, such as a bar.

A wedge-shaped tool, designated generally at 148, is cantilevered from the mounting base 140, so that it extends outwardly in a direction generally parallel to the front face 141 of the base 140. The wedge 148 is formed by oppositely diverging camming surfaces 140, as with the first embodiment discussed with reference FIGS. to 1–3. Again, at least one of the camming surfaces 150 angles acut initiating edge 152 at a free end. As with the first embodiment, a preferred angle would be between 5 degrees and 10 degrees, and a preferred angle located at the free end, which is the angle of the apex of a triangular side 151, would be between 10 degrees and 20 degrees.

The opposing camming surfaces 150 convergently extend from a divergent end 154 to the initiating edge 152 at the free end. In this second embodiment, an integral junction of only one of the camming surfaces 150 provides means joining the divergent end 154 to the base 140; however, the means also include a divergent end closure 156 for returning the upwardly extending camming surface 151 to the base 140.

Either embodiment of the opener 10 or 110 may be made of any of the high strength plastics known to those of ordinary skill in the opener art. Such plastics are characterized as allowing for a relatively smooth and durable finish, particularly for the camming surfaces 50 and 150, and allowing for the use of attractive colors. The opener 10 or 110 may also be made of stainless steel, which would allow its use under regulatory codes for bars and restaurants. Although the bases 40 and 140 of the two embodiments are shown in the figures to be provided with holes 43 and 143 for screws and the like that may be used for attaching the base to a supporting structure, it is to be understood by those of ordinary skill in the art that other suitable attaching means, for example pressure sensitive adhesives backing the base, may be used in lieu of screws and the like.

In either embodiment, but with particular reference again to FIG. 1, the container or can 20 is positioned so that the beveled edge 36 of the tab 28 of the container 20 overlies the initiating edge 52 of the opener 10. The container 20 is pushed generally toward the divergent end 54 of the wedge 48 of the opener 10, and the tab 28 is cammed away from the end wall 22 of the can 20, causing the closure 34 to responsively open.

The tool suggests a novel method for opening a can 20 that has an end surface 22 with a tab 28 attached thereto. A first step of the method involves mounting the opener 10 or 110 described herein to a support surface 46. A second step involves orienting the can 20 so that the end surface 22 is generally above the rest of the can 20. A third step involves positioning the leading edge 36 of the tab 28 of the can 20 against the initiating edge 52 of the opener 10. A final step calls for pushing the can 20 generally horizontally against the initiating edge 52 until the tab 28 is wedged away from the end surface 22, and the closure 34 is pressed open.

I claim:

1. An opener for a tab-top container that has an end wall with a tab attached thereto, the tab having a beveled edge disposed at one end of the tab, the beveled edge lying substantially close to the end wall of the can, and the end wall having a closure located proximate an opposite end of the tab, the tab being pivotable to bring the beveled edge away from the end wall and the closure being openable responsively to the tab being pivoted, the opener comprising:

a base adapted to be mounted to a supporting surface, the base having a front face and a back face;

opposing camming surfaces convergently extending from a divergent end to a juncture;

means joining the divergent end to the base; and an initiating edge forming the juncture, whereby when the can is positioned so that the beveled edge of the tab overlies the initiating edge and the container is pushed generally toward the divergent end of the opener, the tab is cammed away from the end wall causing the closure to responsively open.

2. The opener for a tab-top container as described in claim 1, further comprising attaching means for attaching the base to the supporting surface.

3. The opener for a tab-top container as described in claim 2, wherein the attaching means include spaced holes, each disposed in a corner of the rectangular base for receiving screws capable of penetrating the supporting surface.

4. The opener for a tab-top container as described in claim 2, wherein the attaching means include double-sided pressure-sensitive tap attachable to the back face of the base and to the supporting surface.

5. The opener for a tab-top container as described in claim 1, wherein means joining the divergent end to the base is an integral junction of each of the camming surfaces so that the camming surfaces extend generally perpendicularly from the base, respecting the convergence of the camming surface toward the initiating edge.

6. The opener for a tab-top container as described in claim 1, wherein the opener is made of a high strength plastic.

7. The opener for a tab-top container as described in claim 1, wherein the opener is made of stainless steel.

8. An opener for a can that has a rim surrounding an end wall with a tab attached thereto and a closure that is openable when the tab is pivoted away from the end wall in a preferred direction, the opener comprising:

a base that is mountable to a supporting surface;

two opposing camming surfaces convergently extending from a divergent end to a juncture end;

means joining the divergent end to the base; and an initiating edge forming the juncture end, whereby when the base is mounted to the supporting surface and the can is positioned so that the initiating edge is juxtaposed to the tab, one of the camming surfaces is substantially in contact with the can, and the other camming surface ramps away from the end wall in the preferred direction.

9. The opener for a tab-top container as described in claim 8, wherein, when the base is mounted to the supporting surface and the can is positioned so that the initiating edge is juxtaposed to the tab, the one of the camming surfaces that is substantially in contact with the can is in contact with the rim of the can.

10. A method for opening a can that has an end wall with a tab attached thereto, the tab having a leading edge disposed at one end of the tab, the leading edge lying substantially close to the end wall of the can, and the end wall having a closure located proximate an opposite end of the tab, the tab being pivotable to bring the leading edge away from the end wall and the closure being openable responsively to the tab being pivoted, the method comprising the steps of:

mounting to a support surface an opener having a wedge cantilevered from a support surface mounting base disposed at a mounting end of the opener, the wedge formed by oppositely diverging camming surfaces at least one of which angles acutely upwardly from an initiating edge at a free end of the wedge;

orienting the can so that the end wall is generally above the rest of the can;

positioning the leading edge of the tab against the initiating edge of the opener; and pushing the can generally horizontally against the initiating edge until the leading edge of the tab is wedged away from the end wall, the tab pivots accordingly, and the closure responsively opens.

* * * * *